United States Patent [19]

Knecht et al.

[11] Patent Number: 4,944,433

[45] Date of Patent: Jul. 31, 1990

[54] SEDIMENT BAFFLE FOR VALVES OF PRESSURIZED CONTAINERS

[75] Inventors: Adolf Knecht, Mainz; Ottfried Daab, Ingelheim Am Rhein; Hans-Hermann Weil, Gau-Bickelheim, all of Fed. Rep. of Germany

[73] Assignee: Boehringer Ingelheim KG, Ingelheim am Rhein, Fed. Rep. of Germany

[21] Appl. No.: 303,880

[22] Filed: Jan. 30, 1989

[30] Foreign Application Priority Data

Jan. 28, 1988 [DE] Fed. Rep. of Germany ..... 3802498

[51] Int. Cl.[5] ..... B65D 83/14; G01F 11/32

[52] U.S. Cl. ..... 222/402.2; 222/402.1; 222/564

[58] Field of Search ..... 222/402.1, 402.16, 402.18, 222/402.2, 402.24, 564

[56] References Cited

U.S. PATENT DOCUMENTS 3,464,596 9/1969 Meshberg ..... 222/402.2
4,407,481 10/1983 Bolton et al. ..... 222/402.2 X
4,744,495 5/1988 Warby ..... 222/402.16

FOREIGN PATENT DOCUMENTS 0125865 11/1984 European Pat. Off. ..... 222/402.16
1045876 10/1966 United Kingdom ..... 222/402.1
1336379 11/1973 United Kingdom ..... 222/402.2
2206099 12/1988 United Kingdom ..... 222/402.2
2206100 12/1988 United Kingdom ..... 222/402.2

*Primary Examiner*—Kevin P. Shaver
*Attorney, Agent, or Firm*—D. E. Frankhouser; M-E. M. Timbers; A. R. Stempel

[57] ABSTRACT

A metering valve for a pressurized dispensing container. The container is intended to operate in the inverted position. An element having a raised peripheral portion is provided about the valve housing which substantially closes the space between the wall of the container and the valve housing. The element prevents the settling of active substances of the material being dispensed in the region of the inlet opening of the metering valve.

7 Claims, 3 Drawing Sheets

SEDIMENT BAFFLE FOR VALVES OF PRESSURIZED CONTAINERS

The invention relates to an apparatus for dispensing suspension-based aerosol preparations, and in particular for metering such preparations in therapeutic applications.

Suspensions of extremely finely ground pharmaceutical preparations in the pressurized liquid phase of a propellant (e.g. a fluorochlorohydrocarbon) are of major importance, particularly in the treatment of asthma. The suspensions are packed into pressurized containers with metering valves. By means of the metering valve it is possible to release a specific volume of suspension which is converted by spontaneous evaporation of the propellant into an inhalable aerosol.

For therapeutic reasons it is necessary for the quantity of active substance released on each actuation of the meter in valve to fluctuate as little as possible. The prerequisite for this is a uniform distribution of the particles of active substance in the liquid phase.

Active substances the density of which are greater than that of the liquefied propellants settle when left to sand for lengthy periods. If the aerosol container is in the position of use (with the valve downwards) there is an increase in the concentration of active substance in the region of the inlet opening of the metering valve. Depending on the particular circumstances the increase in concentration, which depends inter alia on the difference in density between the propellant and the pharmaceutical preparation and the length of time it is has been left, may be considerable. A homogeneous suspension can generally easily be reconstituted by shaking. tapping, tilting and also by the vibrations which occur during travel and when the aerosol is carried. If, contrary to the instructions for use for suspension metering aerosols of this kind, the aerosol is not shaken before use and none of the other movements mentioned above takes place, a greatly increased dosage of active substance may enter the metering valve. Consequently in the most serious case, the quantity of active substance released on a single actuation of the aerosol may be several times the intended therapeutic dose.

According to the invention there is provided apparatus for metering suspension-based aerosol preparations containing an active substance with a tendency to settle, comprising an aerosol container with a metering valve, wherein an element is provided disposed about the valve housing and extending radially therefrom toward the wall of said container so as to substantially close the space between the wall of the container and the valve housing, said element having a raised peripheral portion.

By means of this arrangement the danger of overdosing in suspension metering aerosols containing active substances with a tendency to sedimentation is mitigated, by preventing as far as possible any increase in the concentration of active substance in the region of the inlet opening of the metering valve.

In preferred embodiments the radially extending element may comprise any of the following, either individually or in combination,:

1. a funnel shaped element which encloses the valve and is open at the top (in the position of use of the container) and leaves only one opening, e.g. an annular slot, in the region of the container wall;

2. a cover plate, below the funnel when a funnel is provided, which surrounds the valve housing in an annular configuration and substantially fills the internal width of the container;
3. an annular element below the cover plate, (when provided), which substantially reduces the volume in the region of the inlet opening of the valve.

Some embodiments of the invention will now be described by way of example and with reference to the accompanying drawings, in which:

FIG. 1 shows a preferred embodiment of the invention, which will serve as an example. It will be understood that the construction elements may also be used in other conventional metering valves, suitably adapted if necessary.

Figure 1:
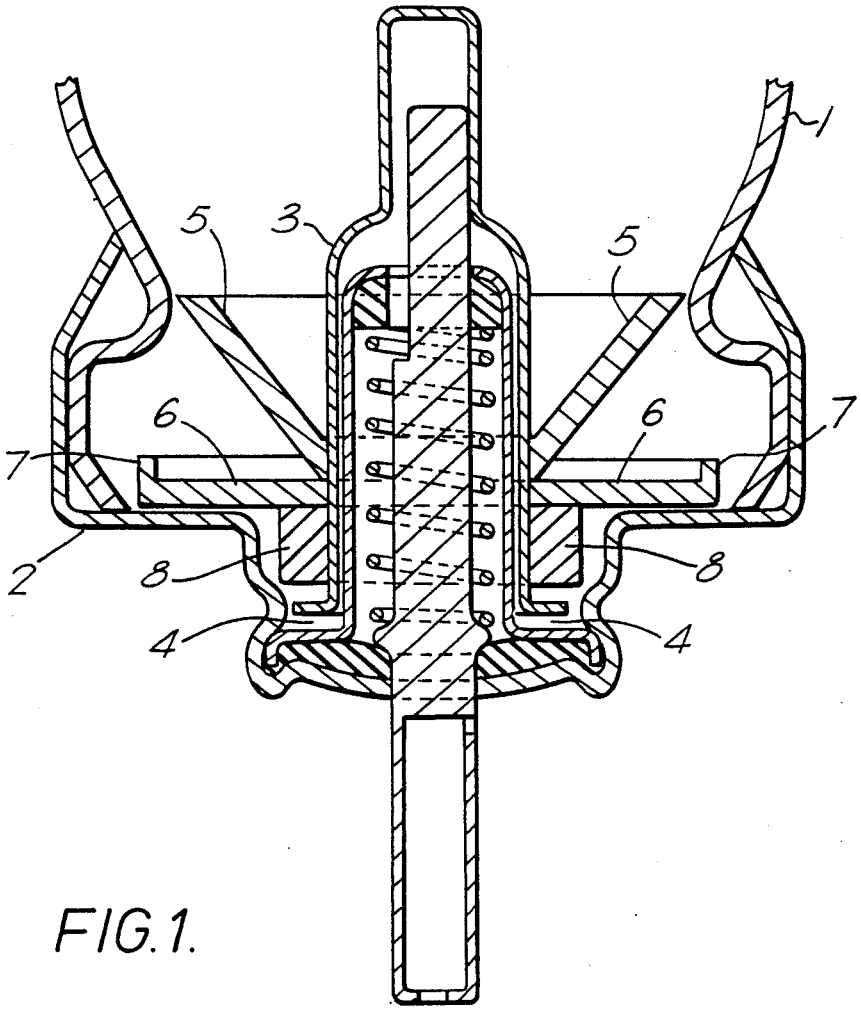
FIG. 1 is a side view in cross-section of a first embodiment.

In FIG. 1, reference numeral 1 denotes the aerosol container, 2 the flange closure cap to which the valve 3 is secured. The valve has an inlet opening 4 for the suspension. This first embodiment comprises a funnel-shaped part 5 below which is mounted a cover plate 6 with a raised edge 7. The volume in the constricted part of the closure cap 2 is partly filed by an element 8. Between the elements 5, 6 and 8 and the wall of the container or the closure cap there is sufficient space to ensure that operation of the valve is not impaired and sufficient quantities of the suspension can travel past these elements to reach the inlet opening 4.

In the case of the valve type shown in FIG. 1, (and also that shown in FIG. 3 to be described below), an outer portion of valve 3 defines a preliminary tank which is fixed to the valve stem and therefore moves with it.

In the case of valves in which the valve member does not move, the construction elements may be shaped so that they abut on the walls of the container and have, as their openings, small openings (e.g. channels, grooves) in the region of the wall.

Figure 2:
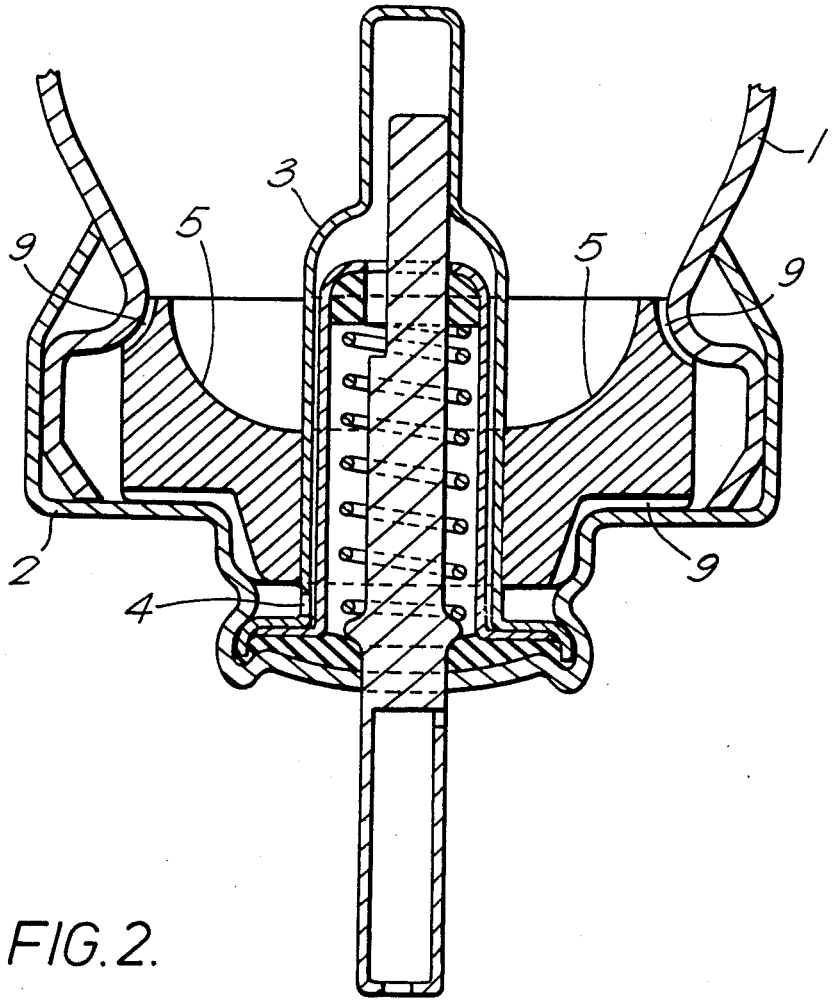
FIG. 2 is a view similar to FIG. 1 showing a second embodiment.

An embodiment of this kind is shown in FIG. 2. Here, the funnel shaped part 5 and the volume-reducing part 8 are combined, dispensing with the cover plate 6. The opening provided for the suspension consists of grooves 9, since the part 5 abuts on the walls of the aerosol container in the upper region and on the wall of the closure cap in the lower region and tightly encloses the valve housing.

Figure 3:
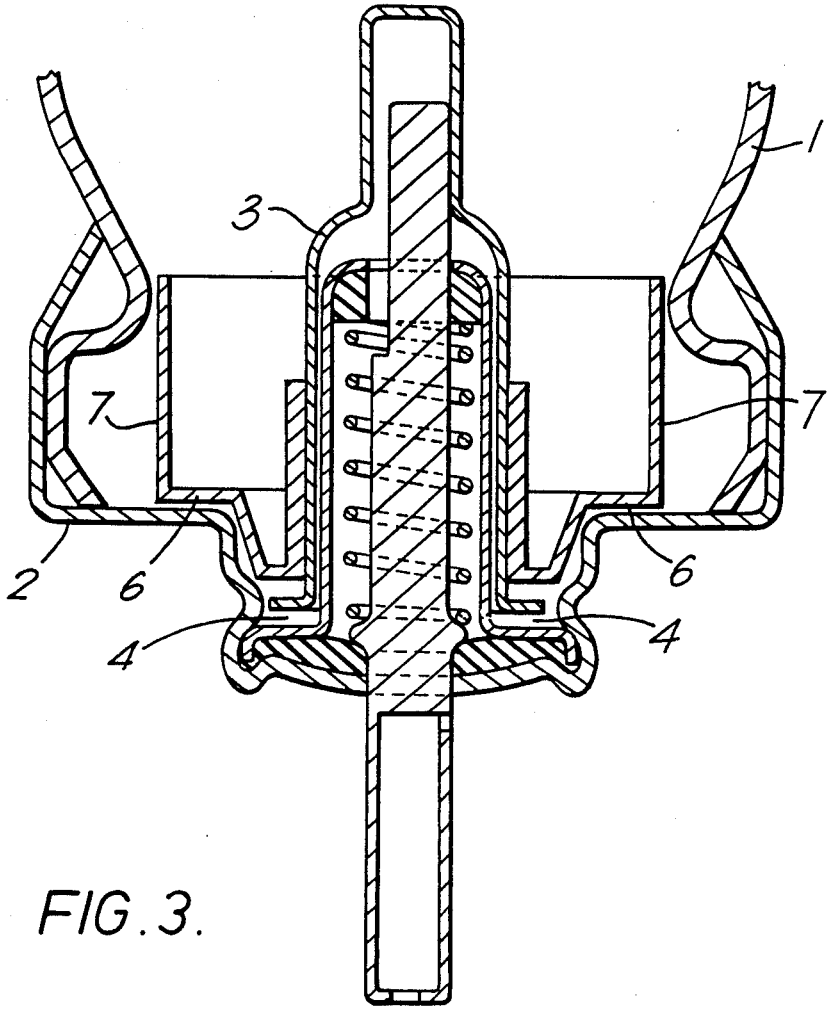
FIG. 3 is a view similar to FIG. 1 showing a third embodiment.

Another embodiment of the invention is shown in FIG. 3, in which the funnel-shaped element 5 has been omitted but the edge 7 of the cover plate 6 is considerably raised.

The elements 5, 6 and 8 may be made from materials which are inert with regard to the suspension, e.g. plastics, stainless steel, aluminum. The elements are constructed, for example, so that they may be secured to the valve housing in a suitable manner or may form part thereof.

What is claimed is:

1. In a valve for dispensing metered doses from a pressurized dispensing container, which container and valve dispenses doses in an inverted position, the valve having a valve housing holding the valve and attaching the valve to the dispensing container so as to create a space between the valve housing and the walls of the dispensing container, the improvement which comprises an element disposed about the valve housing and extending radially therefrom toward the wall of the dispensing container so as to substantially close the space between the wall of the dispensing container and the valve housing, the element having a raised peripheral portion adjacent the wall of the dispensing container.

2. The improvement as recited in claim 1, wherein said element is funnel shaped.

3. The improvement as recited in claim 1, wherein said element is a cover plate with a central opening disposed about the valve housing.

4. The improvement as recited in claim 1, wherein said element further has an annular surface adjacent the valve housing and disposed about the valve housing.

5. In a valve for dispensing metered doses from a pressurized dispensing container, which container and valve dispenses doses in an inverted position, the valve having a valve housing holding the valve and attaching the valve to the dispensing container so as to create a space between the valve housing and the walls of the dispensing container, the improvement which comprises a funnel-shaped element having a neck and a skirt, the neck of such funnel-shaped element being disposed about the valve housing and the skirt of the funnel-shaped element extending radially from the valve housing toward the wall of the dispensing container so as to substantially close the space between the wall of the dispensing container and the valve housing, the skirt of the funnel-shaped element having a raised peripheral portion immediately adjacent the wall of the dispensing container and the neck of the funnel-shaped element having an annular surface around its periphery adjacent the valve housing.

6. The improvement as recited in claim 5, wherein said funnel-shaped element further comprises around its neck a cover plate with a central opening extending radially from the neck to the wall of the dispensing container below the annular surface.

7. In a valve for dispensing metered doses from a pressurized dispensing container, which container and valve dispenses doses in an inverted position, the valve having a valve housing holding the valve and attaching the valve to the dispensing container so as to create a space between the valve housing and the walls of the dispensing container, the improvement which comprises a plate, plate-shaped element with a central opening disposed about the valve housing, the element's flat surface extending radially therefrom toward the wall of the dispensing container so as to substantially close the space between the wall of the dispensing container and the valve housing, the element further having an annular raised edge adjacent the wall of the dispensing container and the element also further having an annular surface around its central opening.

* * * * *